US007255289B2

(12) United States Patent
Ricco et al.

(10) Patent No.: US 7,255,289 B2
(45) Date of Patent: Aug. 14, 2007

(54) FUEL INJECTOR FOR AN INTERNAL-COMBUSTION ENGINE

(75) Inventors: Mario Ricco, Valenzano (IT); Sisto Luigi De Matthaeis, Valenzano (IT); Adriano Gorgoglione, Valenzano (IT); Marco Petrachi, Valenzano (IT)

(73) Assignee: C.R.F. Societe Consortile per Azioni (IT)

( * ) Notice: Subject to any disclaimer, the term of this patent is extended or adjusted under 35 U.S.C. 154(b) by 294 days.

(21) Appl. No.: 11/112,786

(22) Filed: Apr. 21, 2005

(65) Prior Publication Data

US 2006/0102755 A1 May 18, 2006

(30) Foreign Application Priority Data

Nov. 12, 2004 (EP) ..... 04425842

(51) Int. Cl.

| | |
|---|---|
| ***F02M 47/02*** | (2006.01) |
| ***F02M 59/00*** | (2006.01) |
| ***F02M 39/00*** | (2006.01) |
| ***B05B 1/30*** | (2006.01) |

(52) U.S. Cl. ..... 239/88; 239/89; 239/533.2; 239/533.3; 239/533.8; 239/585.1; 239/585.3; 239/585.4; 239/585.5; 239/96

(58) Field of Classification Search ..... 239/88, 239/89, 91, 95, 533.1, 533.2, 533.3, 533.8, 239/533.9, 585.1–585.5; 251/129.15, 129.21, 251/127

See application file for complete search history.

(56) References Cited

U.S. PATENT DOCUMENTS 4,408,718 A * 10/1983 Wich ..... 239/88
4,527,737 A * 7/1985 Deckard ..... 239/89
4,572,433 A * 2/1986 Deckard ..... 239/88
6,425,532 B1 * 7/2002 Popp ..... 239/132.5
6,889,659 B2 * 5/2005 Magel ..... 123/446

FOREIGN PATENT DOCUMENTS

EP 0 823 549 A 2/1998

(Continued)

OTHER PUBLICATIONS

European Search Report EP 04 42 5842 Dated Feb. 28, 2005.

*Primary Examiner*—Davis Hwu
(74) *Attorney, Agent, or Firm*—Ostrolenk, Faber, Gerb & Soffen, LLP

(57) ABSTRACT

A fuel injector (1) for an internal-combustion engine has a shell (2) provided with two opposite terminal portions; the first terminal portion (4) has an inlet (7) for supply of the fuel and is generally designed to extend outside the engine, whilst the second terminal portion (5) has a nozzle (9) communicating with said inlet (7), is designed to be housed in the engine and has, in the radial direction, dimensions smaller than those of the first portion (4); the injector (1) further has an actuator (16) and a servo valve (15) housed in the first terminal portion (4); the servo valve (15) is provided with an open/close element (32), which can slide axially, under the action of the actuator (16) and substantially in a fluid-tight way, in a seat (27) and is subjected to an axial resultant of pressure of the fuel that is substantially zero; the fuel inlet (7) is made laterally in an intermediate axial position between the actuator (16) and the nozzle (9).

6 Claims, 2 Drawing Sheets

FOREIGN PATENT DOCUMENTS

Figure 1:
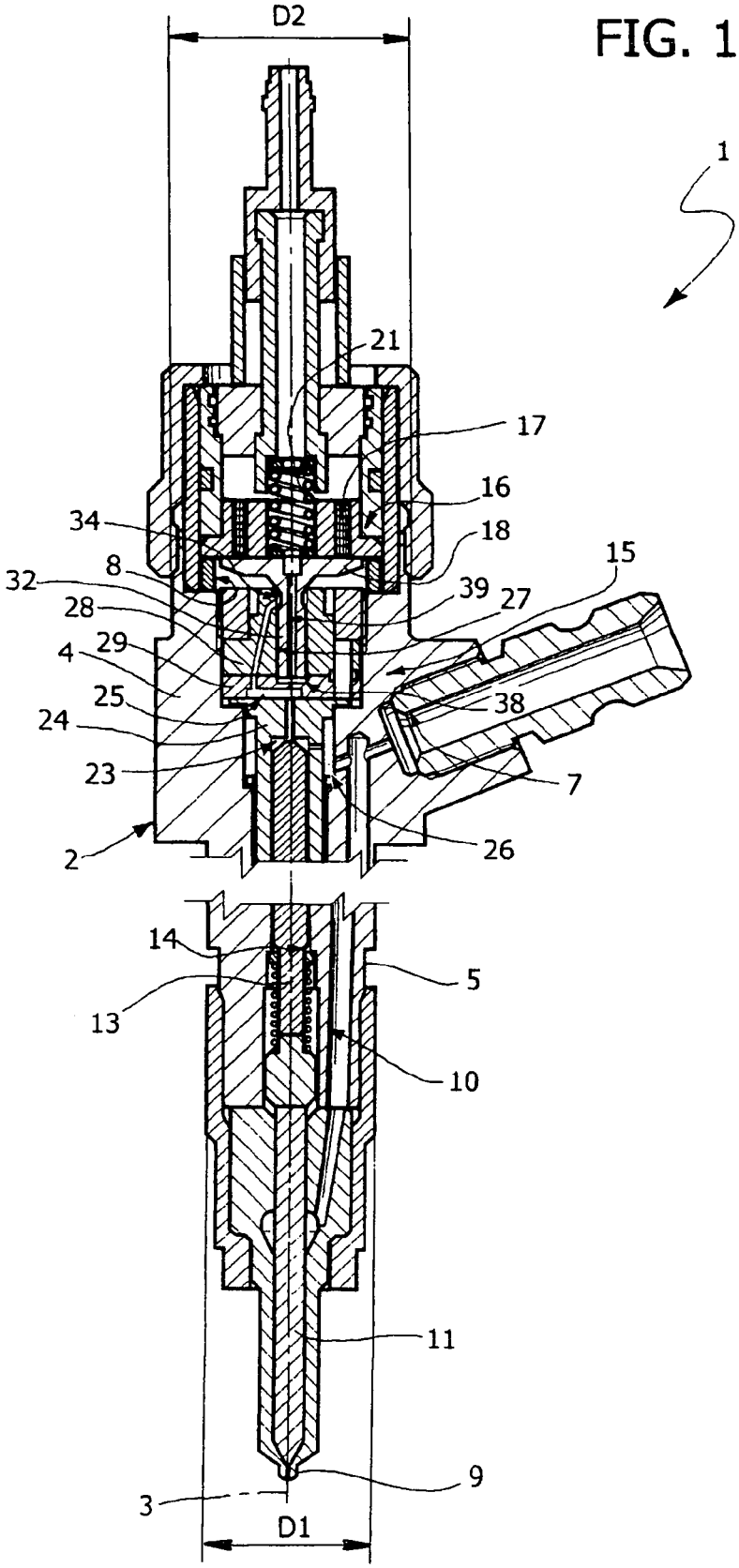

| | | | |
|---|---|---|---|
| EP | 0 916 843 | A | 5/1999 |
| EP | 1 382 837 | A | 1/2004 |
| GB | 2 336 628 | A | 10/1999 |
| GB | 2 350 662 | A | 12/2000 |
| WO | WO 03/004861 | A | 1/2003 |

* cited by examiner

FUEL INJECTOR FOR AN INTERNAL-COMBUSTION ENGINE

The present invention relates to a fuel injector for an internal-combustion engine.

As is known, fuel injectors comprise an outer shell, a terminal portion of which is designed to be housed in a fixed position in the cylinder head and is provided with a nozzle. Opening and closing of the nozzle are performed by a pin that moves along an axis under the control of an actuator, for example of an electromagnetic type.

The shell houses a servo valve, set between the actuator and the movable pin and comprising a control chamber, which has a calibrated inlet channel communicating with the fuel supply, and a calibrated outlet channel, opening and closing of which is performed by an open/close element operated by the actuator.

Known to the art are injectors in which the servo valve and the actuator are arranged in the terminal portion of the injector in the proximity of the nozzle. The servo valve has a substantially cylindrical open/close element, which slides in an axial seat, fixed with respect to the shell, whilst the outlet channel of the control chamber gives out into an annular groove or chamber made radially between the side surfaces of the open/close element and of the axial seat.

In the above known solutions, which are referred to in general as "injectors with balanced servo valves", the axial actions of pressure by the fuel on the open/close element of the servo valve are substantially zero.

However, known injectors with balanced servo valves just described are relatively complex to produce, in so far as the components of the servo valve and of the actuator require extreme machining precision and must have small dimensions in order for them to be housed in a relatively small portion of the shell and to leave an adequate thickness of material in the proximity of the pipes that convey fuel at a relatively high pressure to the nozzle.

Furthermore, the axial balancing of the actions of pressure acting on the open/close element of the servo valve is, in practice, not optimal, for example on account of the machining tolerances, the wear, and the deformations due to thermal stresses deriving from the parts of the engine in contact with the injector and/or to mechanical stresses. The resulting unbalancing is the greater the smaller are the dimensions of the servo valve, in so far as the dimensional variations due to the aforesaid causes are percentagewise more important on small dimensions.

The purpose of the present invention is to provide a fuel injector for an internal-combustion engine which will enable the drawbacks described above to be overcome in a simple and economically advantageous way, improving known injectors with balanced servo valves of the type described above.

According to the present invention, a fuel injector for an internal-combustion engine is provided, said injector comprising:

a) an outer shell elongated along an axis, defining an inlet for supply of said fuel and comprising a first axial terminal portion and a second axial terminal portion opposite to one another, said second axial terminal portion being provided with a nozzle communicating with said inlet and being designed to be housed in said engine;

b) an electrically controlled actuator;

c) a servo valve comprising:

i) an axial seat, fixed with respect to said shell;

ii) an open/close element which can slide axially, under the action of said actuator and in a substantially fluid-tight way, in said seat under the action of said actuator;

iii) a control chamber, communicating with said inlet and having an outlet channel giving out into an annular chamber made radially between the side surfaces of said seat and of said open/close element, so as to render the resultant of the axial actions of pressure on said open/close element substantially zero;

d) a pin, which can move in response to the pressure of said control chamber for opening/closing said nozzle;

said first terminal portion having, in the radial direction, dimensions greater than those of said second terminal portion;

said servo valve and said actuator being housed in said first terminal portion.

Figure 2:
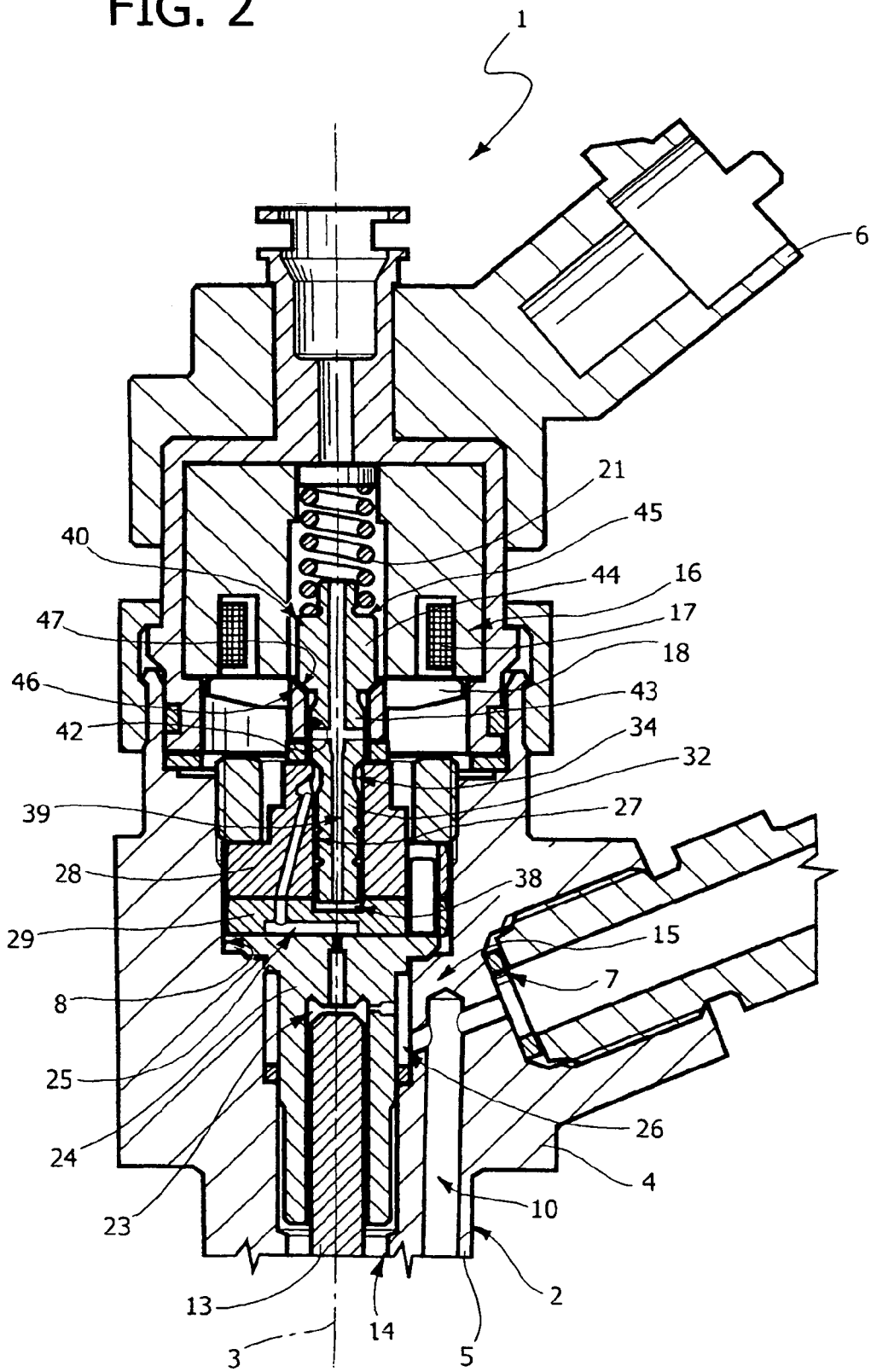

For a better understanding of the present invention, there now follows a description of a preferred embodiment, which is provided purely by way of non-limiting example, with reference to the attached drawings, in which:

FIG. 1 shows, in cross-sectional view and with parts removed for reasons of clarity, a preferred embodiment of a fuel injector for an internal-combustion engine according to the present invention; and FIG. 2 is similar to FIG. 1 and shows, at an enlarged scale, a variant of a detail of the injector of FIG. 1.

In FIG. 1, the reference number 1 designates, as a whole, a fuel injector (partially shown) for an internal-combustion engine, in particular for a diesel engine (not shown).

The injector 1 comprises an outer structure or shell 2, which extends along a longitudinal axis 3 and comprises two opposite axial terminal portions 4 and 5. The portion 4 generally extends, in use, outside the engine, carries an axial connector 6 for electrical supply (visible in the solution of FIG. 2), has a side inlet 7 designed to be connected to a system (not shown) for supply of fuel, and defines an internal cavity 8. The portion 5, instead, has, in a direction transverse to the axis 3, an external dimension D1 smaller than the dimension D2 of the portion 4, is generally housed, in use, in a fixed position in the cylinder head, and ends with an atomizer. The atomizer comprises: a nozzle 9, which is designed to inject the fuel into a corresponding cylinder of the engine and communicates with the inlet 7 through a pipe 10 made in the portion 5 in an eccentric position with respect to the axis 3; and a pin 11, which is axially movable for opening/closing the nozzle 9 under the control of a rod 13 (partially shown). The rod 13 engages a seat 14 (partially shown) made in the portion 5 along the axis 3 and giving out into the cavity 8, is coaxial to the pin 11, and is axially slidable in the seat 14 under the control of a servo valve 15 actuated by an electrically controlled actuator 16. The servo valve 15 is set in an intermediate axial position between the rod 13 and the actuator 16. The actuator 16 and the servo valve 15 are both housed in the portion 4.

In particular, the actuator 16 is coaxial to the rod 13 and comprises: an electromagnet 17, electrically supplied through the connector 6; an anchor 18, which has a generally sectored shape and is axially movable under the action of the electromagnet 17; and a pre-loaded spring 21 surrounded by the electromagnet 17 and exerting an action of thrust on the anchor 18 in a direction opposite to the attraction exerted by the electromagnet 17 itself.

The servo valve 15, instead, comprises a control chamber 23, which is defined by one end of the rod 13 and by a body 24 shaped like a beaker turned upside down that is fixed with respect to the shell 2, has a channel 25 for outlet of the fuel, the shape and arrangement of which is not described in detail, and communicates with the inlet 7 through a passage 26 partly made through the body 24 and partly through the shell 2.

The servo valve 15 further comprises a seat 27 made along the axis 3 through a body 28, which is housed in the cavity 8 in a fixed position with respect to the shell 2 and is coupled to a disk 29 so that it axially bears thereupon and is in a fixed reference angular position, said disk 29 being set between the bodies 24, 28.

The seat 27 is engaged by an open/close element 32, which is defined by a substantially cylindrical axial pin, is fixedly connected to the anchor 18, and is axially slidable in the seat 27, substantially in a fluid-tight way, under the action of the electromagnet 17 for opening/closing the outlet of the channel 25.

In particular, the channel 25 is made in the bodies 24, 28 and in the disk 29 and gives out into an annular chamber 34 made, radially, between the internal side surface of the seat 27 and the external side surface of the open/close element 32, so as to render substantially zero the resultant of the axial actions of pressure on the open/close element 32 itself. In particular, the chamber 34 is dug into the external side surface of the open/close element 32.

The outlet of the channel 25, defined by the chamber 34, is opened, in use, by the displacement of the open/close element 32 into a raised opening position, following upon excitation of the electromagnet 17. In said operating condition, the channel 25 and, hence, the chamber 23 are set in communication with a discharge pipe, so that the pressure in the chamber 23 decreases, causing raising of the rod 13 and thus opening of the nozzle 9. Once excitation of the electromagnet 17 has terminated, the elastic action of the spring 21 causes lowering of the open/close element 32 into the closing position, with a consequent increase in the pressure in the chamber 23 and, hence, closing of the nozzle 9.

When the injector 1 is mounted, i.e., in the conditions shown, the seat 27 axially ends with a blind portion 38, which is defined by the disk 29 and by the open/close element 32, and communicates with the aforesaid discharge pipe via a through hole 39, which is made through the open/close element 32 along the axis 3 and is distinct from the chamber 34.

According to a variant (not shown), the blind portion 38 is defined axially by the open/close element 32, on one side, and by an applied plate, on the other side. Said plate closes an axial through opening made in the disk 29.

FIG. 2 shows a variant of the injector 1, the constituent parts of which are designated, where possible, by the same reference numbers as the ones used in FIG. 1.

According to said variant, the open/close element 32 forms part of a pin 40 distinct from the anchor 18. The anchor 18 has a cylindrical axial hole 42, whilst the pin 40 comprises an intermediate portion 43, which engages the hole 42, and a terminal portion 44 opposite to the open/close element 32. The portion 44 is housed in the electromagnet 17 in an axially slidable way, has an end face 45 set bearing axially upon the spring 21, and is connected to the portion 43 by means of a shoulder 46 set bearing upon a shoulder 47 of the anchor 18. According to a preferred embodiment, the coupling between the shoulders 46, 47 is defined by a coupling between a spherical surface and a conical surface, so as to obtain an articulated joint.

During excitation of the electromagnet 17, the shoulder 47 pushes the portion 44 axially so as to raise the open/close element 32 and hence cause opening of the nozzle 9. Once excitation of the electromagnet 17 has ceased, the elastic action of the spring 21 causes lowering of the pin 40 until the chamber 34 is closed, so as to bring about closing of the nozzle 9, whilst the shoulder 46 pushes the anchor 18 axially in a direction opposite to the electromagnet 17.

From the foregoing description, it is evident that the servo valve 15 of a balanced type has available a relatively large space in a direction transverse to the axis 3 in the portion 4, as compared to that available in the portion 5, in so far as, as has been described, the portion 4 has a diameter greater than the portion 5.

It is moreover evident that, since the inlet 7 is made laterally in an intermediate axial position between the seat 27 and the nozzle 9, it enables prevention of passage of fuel at a relatively high pressure in the proximity of the servo valve 15, contributing to increasing the space available for the servo valve 15 and at the same time to improving the hydraulic lay-out inside the electroinjector 1, both from the standpoint of simplification of the construction of the internal holes and from the standpoint of optimization of the permeability of the holes and of the points of crossing-over thereof. The pipe 10, in fact, extends alongside the seat 14, and not alongside the cavity 8 in which the servo valve 15 is partially housed.

Consequently, since it is possible for the servo valve 15 to have larger dimensions (in particular the diameters of coupling and of seal may be greater) given the same precision required, the fabrication and machining of its components are simpler as compared to known solutions in which the servo valve of a balanced type described is housed in the terminal part near the nozzle, which is inserted in the engine. In particular, the dimensions of the diameters of the coupled surfaces and of the diameters of sealing may be similar to those of the atomizers, enabling use for their fabrication of the same process technologies as those used for the atomizers, which are by now consolidated and well tested. It is then possible to use an electromagnet 17 of relatively large dimensions in the radial direction, with the consequent possibility of having actuation forces approximately five times greater than those of known solutions in which the actuator is housed in the terminal portion of the injector that is inserted in the engine.

Thanks to the greater actuation forces exerted by the actuator 16, for the open/close element 32 (which only theoretically is perfectly balanced) it is possible to tolerate, and compensate, in use, even the imbalance of actions along the axis 3, due for example to machining tolerances, wear, and deformations due to thermal and/or mechanical stresses.

Thanks to the space available in the radial direction, the diameter of sealing of the pipes of the servo valve 15 may be greater, so that, given the same outflow necessary for correct operation of the injector 1, it is possible to envisage, for the open/close element 32, strokes equal to approximately one half those of known solutions of a balanced type, with consequent further benefits in the dynamic behaviour of the injector 1. In particular, in this way, it is possible to improve the reproducibility of any possible close multiple injections and decrease the distance in time between the individual injections, in so far as the dynamic phenomena, generally of an elastic and electromagnetic nature, generated by the mechanisms of opening and closing of the servo valve 15 are exhausted in times that are shorter than those of known solutions and correspond to approximately 30 microseconds. The effects of the reduction in the stroke of the open/close element 32 are even more important on account of the fact that the correlation between the stroke of the open/close element and the switching times for opening/closing (and vice versa) of the servo valve 15 is not linear, in so far as the percentage reduction in the switching times is approximately four times greater than the percentage reduction in the stroke of the open/close element.

Furthermore, the relatively small values of the stroke of the open/close element 32 simplify considerably the achievement of the end-of-travel of the open/close element 32 itself, in so far as it is possible to obtain it by causing the anchor 18 to hit axially against the front wall of the electromagnet 17 (with or without interposition of intermediate means) thanks to the reduced momentum to be absorbed. Furthermore, if the surfaces that come into contact during impact have an area greater than 0.5 square centimetres, an effect of damping of the anchor 18 is obtained, which further improves the dynamic behaviour of the injector 1.

The reduced strokes of the open/close element 32 also reduce the effects of wear of the components coming into contact, with a corresponding smaller variation in time of the stroke of the open/close element 32. In particular, if said stroke is halved with respect to known solutions of a balanced type described above, after approximately two hours of normal operation of the injector 1, the variation of the stroke itself due to wear is approximately eight times smaller.

The architecture forming the subject of the present patent further enables use of the well-validated "two-pin" architecture for the electroinjector 1, i.e., it makes it possible to keep the two components, the rod 13 and the pin 11, physically and functionally distinct. The rod 13 and the pin 11 can have different diameters with respect to one another and such as to determine an appropriate difference in area, which will generate a force capable of improving the mechanisms of opening and closing of the nozzle 9.

In addition, the hole 39 is relatively easy to make and does not entail any further machining operations either on the shell 2 or on the servo valve 15 in order to set the portion 38 of the seat 27 in discharge.

Finally, it is clear that modifications and variations may be made to the injector 1 described and shown herein, without thereby departing from the sphere of protection of the present invention, as defined in the annexed claims.

In particular, there could be provided an electrically controlled actuator different from the one described herein by way of example.

The invention claimed is:

1. A fuel injector (1) for an internal-combustion engine, said injector comprising:

a) an outer shell (2) elongated along an axis (3), defining an inlet for supply of said fuel and comprising a first axial terminal portion (4) and a second axial terminal portion (5) opposite to one another, said second axial terminal portion (5) being provided with a nozzle (9) communicating with said inlet (7) and being designed to be housed in said engine;

b) an electrically controlled actuator (16);

c) a servo valve (15) comprising:

i) an axial seat (27), fixed with respect to said shell (2);

ii) an open/close element (32) which can slide axially, under the action of said actuator (16) and in a substantially fluid-tight way, in said seat (27) under the action of said actuator (16);

iii) a control chamber (23), communicating with said inlet (7) and having an outlet channel (25) giving out into an annular chamber (34) made radially between the side surfaces of said seat (27) and of said open/close element (32), so as to render the resultant of the axial actions of pressure on said open/close element (32) substantially zero;

d) a pin (11), which can move in response to the pressure of said control chamber (23) for opening/closing said nozzle (9);

said first terminal portion (4) having, in the radial direction, dimensions greater than those of said second terminal portion (5); said servo valve (15) and said actuator (16) being housed in said first terminal portion (4).

2. The injector according to claim 1, characterized in that said inlet (7) is made laterally in an intermediate axial position between said actuator (16) and said nozzle (9).

3. The injector according to claim 2, characterized in that said inlet (7) is made laterally in an intermediate axial position between said nozzle (9) and said seat (27).

4. The injector according to claim 1, characterized in that said actuator (16) comprises an electromagnet (17) and an anchor (18), which is axially movable under the action of said electromagnet (17), said anchor (18) and said open/close element (32) being fixedly connected together.

5. The injector according to claim 1, characterized in that said actuator (16) comprises an electromagnet (17) and an anchor (18), which is axially movable under the action of said electromagnet (17), said anchor (18) and said open/close element (32) being defined by pieces distinct from one another.

6. The injector according to claim 1, characterized in that said seat (27) axially ends with a blind portion (38), said open/close element (32) having a through hole (39) distinct from said annular chamber (34) for setting said blind portion (38) in communication with a pipe for discharging fuel from said injector (1).

* * * * *

UNITED STATES PATENT AND TRADEMARK OFFICE

CERTIFICATE OF CORRECTION

PATENT NO. : 7,255,289 B2
APPLICATION NO. : 11/112786
DATED : August 14, 2007
INVENTOR(S) : Mario Ricco et al.

It is certified that error appears in the above-identified patent and that said Letters Patent is hereby corrected as shown below:

(73) Assignee: C.R.F. Societa Consortile per Azioni, Orbassano (IT)

Signed and Sealed this

Tenth Day of March, 2009

JOHN DOLL
*Acting Director of the United States Patent and Trademark Office*